US005295372A

United States Patent [19]

Kemper et al.

[11] Patent Number: 5,295,372

[45] Date of Patent: Mar. 22, 1994

[54] WARP KNITTING MACHINE WITH A COMPENSATED GUIDE BAR

[75] Inventors: Rainer Kemper; Karl Winter, both of Obertshausen, Fed. Rep. of Germany

[73] Assignee: Karl Mayer Textilmaschinenfabrik GmbH, Obertshausen, Fed. Rep. of Germany

[21] Appl. No.: 928,778

[22] Filed: Aug. 13, 1992

[30] Foreign Application Priority Data

Aug. 19, 1991 [DE] Fed. Rep. of Germany ..... 4127344

[51] Int. Cl.[5] ..... D04B 27/26

[52] U.S. Cl. ..... 66/207; 66/204; 66/208

[58] Field of Search ..... 66/204, 205, 207, 208, 66/203, 206

[56] References Cited

U.S. PATENT DOCUMENTS 3,802,227 4/1974 Kolar et al. ..... 66/205
4,614,095 9/1986 Porat ..... 66/207
4,776,185 10/1988 Roth ..... 66/207

FOREIGN PATENT DOCUMENTS 3213663 10/1983 Fed. Rep. of Germany ..... 66/207

*Primary Examiner*—Clifford D. Crowder
*Assistant Examiner*—Larry D. Worrell, Jr.
*Attorney, Agent, or Firm*—Omri M. Behr; Matthew J. McDonald

[57] ABSTRACT

In a warp knitting machine at least one swingable guide bar is driven in a shogging direction. This displacement is achieved through a drive member via a hinged push rod in dependence upon a path time function. This path time function is formed by overlapping a ground function with a compensation function. The ground function is the targeted displacement movement of the guide bar for proper lapping. The compensation function compensates for an axial mislap and possible collision during the swing-through of the guide bar. The compensation occurs at least during that segment corresponding to the passage of the guides through the needle gaps. Preferably however, compensation occurs over the entire ground function. This compensation substantially reduces the danger of collision between the guides and the needles.

13 Claims, 4 Drawing Sheets

X
15
U
16
T (α)

X
17
V
18
T (α)

X
W
19
20
21
T (α)
0°
360°
720°

WARP KNITTING MACHINE WITH A COMPENSATED GUIDE BAR

BACKGROUND OF THE INVENTION

The present invention is directed to a warp knitting machine having at least one guide bar, which is: (a) swingable about an axis parallel to its own axis to achieve the swing-through of the guides through the needle gaps; (b) displaceable by a drive means in an axial direction to achieve the underlaps and overlaps, the drive means having a drive member that moves axially in accordance with a predetermined path time function, and (c) acted upon by means of a hinged push rod.

Such warp knitting machines are generally commercially available (see Terminology of Warp Knitting, 1980, page 21). A useful drive member is an axially led rod, the so-called flyer or rocking lever, which is displaced by a pattern or cam disc in accordance with the desired lapping pattern. This axial movement is transferred, by means of a push rod, onto the guide bar, whereby hinge points are required at both ends of the push rod so that the transfer of the movement is possible despite the swinging of guide bars.

The relative position of the guide bar with respect to the needle bar must be set very precisely so that during the swing-through, the guides do not touch the needles, because touching could lead to damage of both the thread and the needles. It is thus known to provide, between the pattern plate and the push rod, an arrangement for changing the length of the transfer system either in the form of a screw element (see Wheatley, Raschel Lace Manufacture, 1972, page 20) or as a temperature sensitive setting member (DE PS 38 23 757). Regrettably, this only serves to solve the problem to a certain extent, in particular when dealing with small needle spaces and high machine speeds.

SUMMARY OF THE INVENTION

It is thus an object of the present invention to provide a warp knitting machine of the general class described herein, wherein the danger of a collision between the needles and the guides is reduced considerably.

In accordance with the illustrative embodiments demonstrating features and advantages of the present invention, there is provided a warp knitting machine having a plurality of needles separated by a plurality of needle spaces. The machine has at least one guide bar with a longitudinal axis and a plurality of spaced guides. This guide bar can swing about an axis parallel to the longitudinal axis to move the guides through the needle spaces. A drive arrangement can axially displace the guide bar to perform underlaps and overlaps. The drive arrangement has a push rod and a drive member. The push rod is coupled to the guide bar for axially moving it. The push rod is mounted with freedom to move in a manner more complex than axial translation. The drive member is coupled to the push rod at a joint for axially moving the joint in accordance with a predetermined path time function. This predetermined path time function has a component of axial motion as the guides pass through the needle spaces. The predetermined path time function comprises a combination of: (a) a compensating function for compensating for complex motion of the push rod, and for mislap of the guide bar tending to cause the needles and the guides to touch, and (b) a ground function representing the net axial motion of the guide bar. The ground function equating to a displacement of the guide bar needed to achieve an improved lapping, at least during the passage of the guides through the needle gaps.

An improved warp knitting machine is achieved in that for forming a path time function, a ground function (which is equal to the displacement movement necessary for the desired lapping of the guide bar, at least in that the passage of the guides through the appropriate segment of the needle gap), is overlapped by an compensating function which compensates for an axial mislap tending to cause a contacting swing-through.

The path time function which is put together from the ground function and the compensating or equalizing function, takes account of the fact that while the push rod has a constant length, its component along the axis of the guide bar changes. The axial length, which establishes the displacement of the guide bar, is altered during the swinging of the guide bar about the horizontal axis. When, in the conventional way, the drive element is moved in accordance with the desired ground function, the guides do not run through the needle gaps according to the ground function but on a path displaced therefrom. On the other hand where, the drive member follows the combined ground function and compensation function, the guides, despite their swinging, follow a path prescribed by the ground function.

Thus, the danger of a collision between the guides and the needles is correspondingly small. Above all, control can be obtained even when running the equipment through narrow needle gaps. Furthermore, one can function with higher machine speeds despite the thus unavoidable swinging of the needles, since the entire width of the needle gaps is available for the swinging needles.

It is particularly advantageous when the compensating function overlaps the entire ground function. This means that the mislap, which is called forth by the deflection of the push rod is substantially completely avoided. Therefor the motion equation which the guide bar follows corresponds to the desired ground function. This is of particular interest because otherwise the mislap leads to an undesired acceleration of the guide bar and thus, to higher loads on the entire system and additional undesired swings. It is particularly advantageous therefore, if the ground function comprises segments of constant acceleration.

In one embodiment, the path time function is prescribed by the circumferential surface of a cam plate which operates upon the drive member by a contact roller. This cam plate is distinguished from the known cam plate by the new path time function.

In a preferred further embodiment the path time function is prescribed by data stored in a computer, which activates an axially operating motor, suitably, an electrical motor. Such a computer can store a plurality of movement equations. It is also possible by this means to calculate different path time functions from a small number of stored data.

It is particularly desirable to provide that the computer has a first storage area for the takeup of ground function data, a second storage area for the takeup of compensation function data, as well as a computational area for the calculation of a path time function by the adding or subtracting of the two previously named data. Where a unique compensation function is provided for each guide bar, one may drive the guide bar with very different ground functions and still obtain the desired path time function through a simple calculation process.

DETAILED DESCRIPTION OF THE PREFERRED EMBODIMENT

Figure 1:
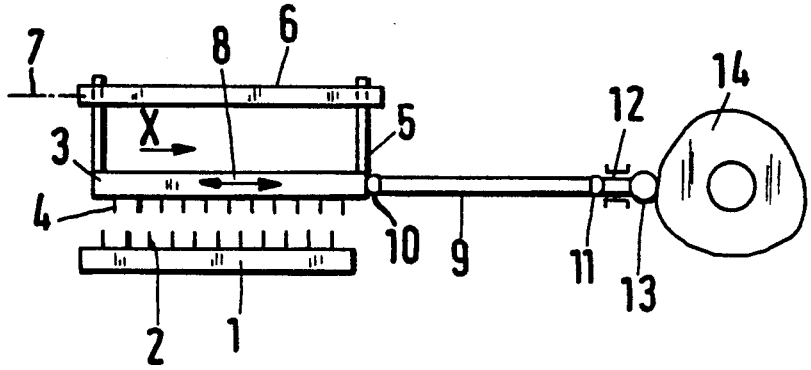
FIG. 1 is schematic, front elevational view of the operative parts of a warp knitting machine in accordance with principles of the present invention.
Figure 2:
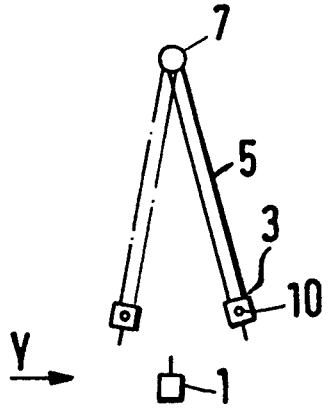
FIG. 2 is an end view of the guide bar mechanism of FIG. 1.

FIGS. 1 and 2 illustrates in a simplified manner for a warp knitting machine, needle bar 1 with the appropriate spaced needles 2 and a guide bar 3 with the appropriate spaced guides 4. Guide bar 3 is attached to a supporting shaft 6 by a pair of arms 5, which connect to opposite end of guide bar 3. Guide bar 3 is thus swingable about a horizontal axis 7 through a predetermined angle, which is encompassed in FIG. 2 between the positions of guide bar 3 that are fully illustrated and shown in phantom. This swinging displacement is identified in FIG. 2 as abscissa Y.

Guide bar 3 can be mounted with the usual mechanisms to allow shogging in the direction of double of double arrow 8 (also identified as ordinate X). For directing the shogging, guide bar 3 is connected to horizontally oriented drive means 12 including a rod supported in a linear bearing connected to a push rod 9. Push rod 9 has at either end a hinge 10 and 11. To the right (as seen in FIG. 1) of drive means 12 is a contact roller 13 which is driven by cam plate 14. Roller 13 is urged toward cam plate 14 under the influence of a non-illustrated spring.

Figure 3:
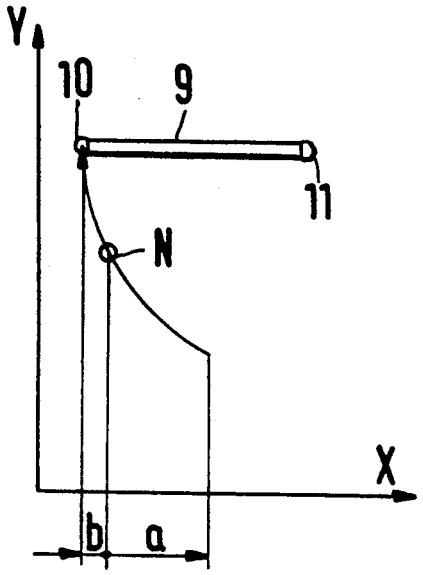
FIG. 3 graphically relates the uncompensated movement of the guide bar in axial displacement direction X with the swing through in direction Y.

With the axial displacement direction designated X and the swinging direction Y, FIG. 3 shows that given a stationary hinge point 11 (that is to say, cam plate 14 is stationary), solely by means of the swinging of the guide bar 13, a mislap occurs. This mislap is shown here, with respect to the mid-point N, having the values a and b. The cause of the mislap is the fact that the constant length push rod 9, but its axial component varies as the guide bar swings.

Figure 4:
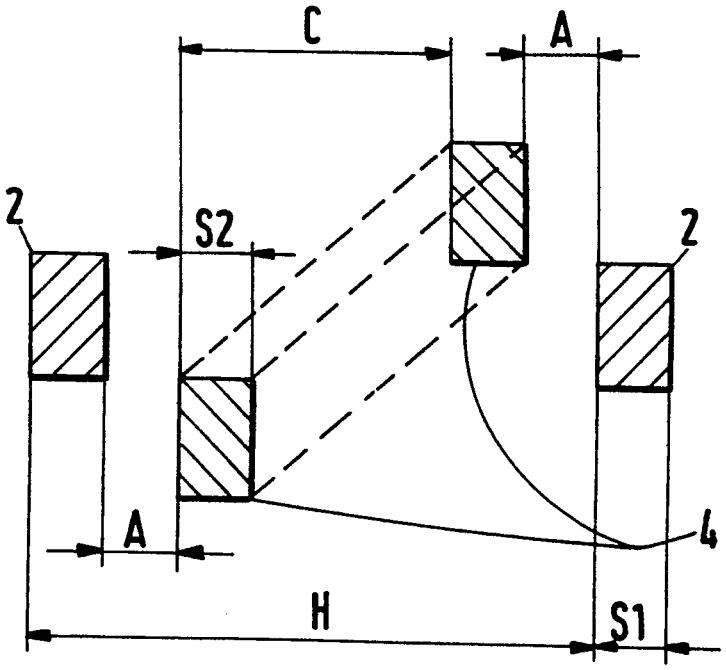
FIG. 4 shows the trajectory of the guides during movement through the needle passages.

The consequences of this situation are illustrated in FIG. 4. Guides 4 do not pass between needles 2 along an undeflected path that is perpendicular to the row of needles. Guides 4 follow a slanted path during passage through the gaps between needles 2. If distance A is the safety margin for material expansion and the like, S1 is the thickness of needle 2 and S2 is the thickness of guide 4, then the maximum permissible deflection C in path 3 in a needle to needle direction when guides 4 are between needles 2 can be expressed as:

$$C=H-2A-S1-S2.$$

wherein H represents the needle to needle spacing. If the displacement exceeds C, the guides and the needles collide. If the machine speed is higher so that during the needle swings the safety margin A is no longer sufficient, then similarly, a collision occurs.

Figure 5:
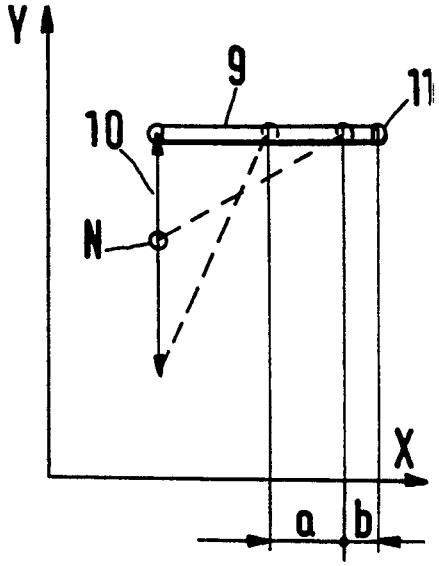
FIG. 5 is a diagram similar to FIG. 3 but showing the compensation of the appropriate additional path.

In accordance with the present invention, the guide bar 3, during its swinging movement, should travel as defined in the ground function shown in FIG. 5, wherein no displacement of the guides is desired along axial direction X. In order to achieve this end, during the swing through of the guide bar 3, the setting of the drive member 12 must be alerted in such a way that the hinge 10 stays at the same axial station. Consequently, compensation of the path deflection caused by the guide swing (again with respect to the needle gap mid-point N) is achieved by an additional stroke a in one end position and in the other position by a counter-directed additional stroke b. This compensation applies at least during the passage of the guides through the needle gaps but preferably applies over the entire swinging path.

Figures 6, 7, 8:
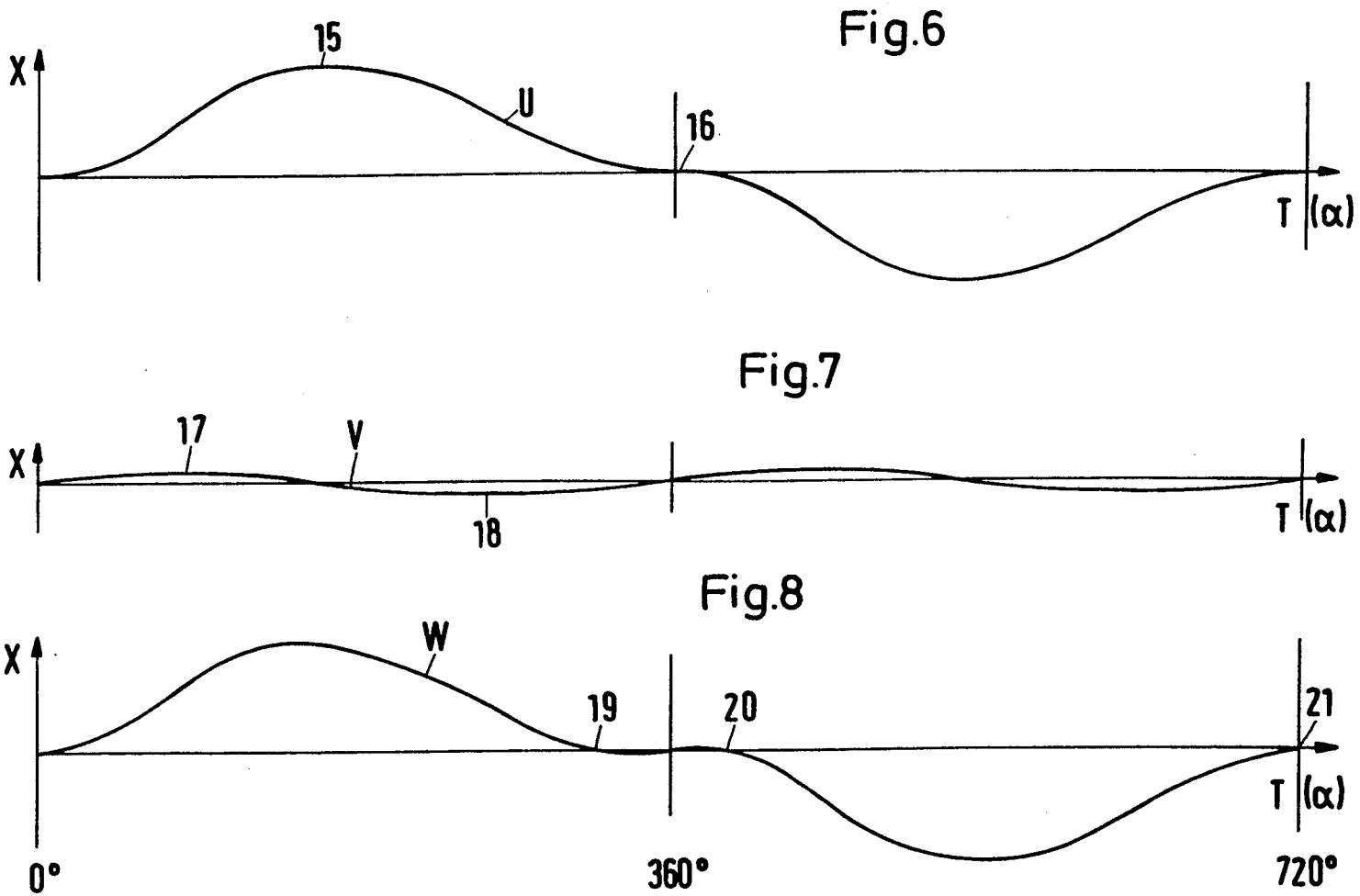
FIG. 6 is the ground function for a twin timed work cycle.
FIG. 7 is the compensation function shown as a function of the particular swing angle of the guide bar.
FIG. 8 is the combination of the functions of FIGS. 6 and 7 to produce the path time function.

This compensation is further illustrated in FIGS. 6 through 8 which illustrate the appropriate functions in two revolutions of the machine main shaft (not shown). In FIG. 6, the ground function U, shown as a function of time (or equivalently for constant shaft speed, angle $\theta$ of the machine main shaft) path time function), represents the desired displacement of the guide bar in axial displacement direction X over time T. For each main shaft revolution there are two transition areas 15 and 16 in which the guides move through the needle gaps. These areas 15 and 16 also represent the center or neutral position for the guides. At these points the axial movement of the guide bar should be as small as possible. Thus transition areas 15 and 16 are established as null points with a zero rate of change.

FIG. 7 shows a compensating function V directed to compensating for the swing through of the guides. Here, for each machine main shaft revolution there are two reversal points 17 and 18 (null rate of change) which correspond to the additional strokes A and B of FIG. 5.

FIG. 8 shows the combination or overlapping of ground function U and compensation function V, giving rise to a path time function W. The location of neutral positions of the guide in the area between points 19 and 20 and in the vicinity of point 21 are different.

Since previously the ground function U was represented on cam plate 14 (FIG. 1), the displacement of guide bar 3 proceeds by a combination of the compensating function V via a path time function similar to W. This results in the path of the guides through the needle gaps being altered and is changed differently in accordance with the direction of the displacement. In accordance with present invention, guide bar 3 should follow the ground function U so that, the path time function W should be represented on the cam plate or similar patterning arrangement.

This compensated shape can be determined by loading the ground function U and the compensation function V through a computer program and combining them to yield the path time function W. From these data one can establish the data necessary to form an appropriate cam plate 14 or for the direct computer control of the displacement movement.

Figure 9:
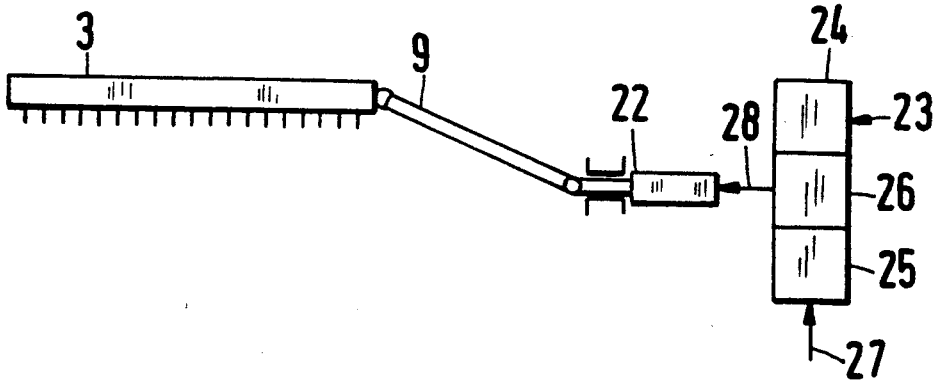
FIG. 9 is a schematic of further embodiment of the invention.

FIG. 9 shows an embodiment that is an alternate to that of FIG. 1 wherein guide bar 3 is displaced via push rod 9 by drive member 22 in the form of a linear electrical motor. Motor 22 receives its control signals from computer 23, which comprises a first storage area 24 for the receipt of the data of the ground function U, a second storage area 25 for the take-up of data of the compensation function V and a computing means 26 for adding or subtracting the appropriate data. When the angle setting of the main shaft of the warp knitting machine is provided to input 27, the output 28 provides the appropriate values of the path time function W. Input 27 may be connected to a conventional digital shaft encoder (not shown) that provides a digital representation of the main shaft position. In some embodiments the shaft encoder can provide marker pulses for each revolution of the main shaft, followed by a pulse train having a repetition rate proportional to shaft speed.

As an example, storage area 25 may contain compensating functions for each guide bar and the appropriate swinging movement. From storage area 24, the desired position can be called out for the appropriate ground function. This arrangement can provide many combination possibilities. Generally speaking, it is sufficient to provide the ground function U for displacement around a single needle. For larger displacements, it is only necessary to multiply this curve by the appropriate factor. The values from the compensation function are comparatively small. They are thus most readily calculated by means of a computer program which duplicates the swinging movement of the guide bars in the desired step width.

In addition to the ground function U illustrated in FIG. 6, other ground functions may also be considered; for example, a 3-point displacement curve. Instead of the standard type drive member 12 which is held in an axial guide, it is also possible to utilize a lever type drive member whose hinge combination with the push rod is moved via the axial guide to the approximately correct curve segment.

We claim:

1. A warp knitting machine comprising:

a machine frame;

a plurality of needles arranged in a row and spaced from each other to form a plurality of needle spaces;

guide bar means including at least one guide bar having a longitudinal axis and a plurality of spaced guides, said guide bar means including means for (a) mounting said guide bar in said machine frame (b) allowing said guide bar to swing about an axis parallel to said longitudinal axis and (c) permitting shogging and longitudinal positioning of said guide bar to allow said plurality of guides to pass through said plurality of needle spaces as said guide bar swings; and a drive arrangement for shogging said guide bar to perform underlaps and overlaps, said drive arrangement including:

a push rod means including a push rod coupled to said guide bar for shogging it, said push rod means including means for mounting said push rod with a degree of freedom including more than axial translation; and a drive member means coupled to said push rod means at a joint for axially moving the joint along a joint path with a predetermined path time trajectory, said joint path with said predetermined path time trajectory having a component of axial motion while said plurality of guides pass through said plurality of needle spaces when the guides are at a position between adjacent ones of the needles, said drive member means comprising, in combination, (a) means for imparting to said predetermined path time trajectory a compensating component for compensating for non-axial motion of said push rod means, and for mislap of said guide bar tending to cause said needles and said guides to touch, and (b) means for imparting to said predetermined path time trajectory a ground component that represents the net axial motion of the guide bar during the passage of said guides through the needle gaps, the ground component of said predetermined path time trajectory having segments of substantially constant acceleration.

2. A knitting machine according to claim 1 wherein said joint path with said predetermined path time trajectory has, as said guides pass through said needle spaces, a component of axial motion exceeding that of said ground portion.

3. A knitting machine according to claim 2 wherein said compensating portion is coextensive with said ground portion.

4. A warp knitting machine according to claim 1 wherein the ground portion of said predetermined path time trajectory comprises segments of substantially constant acceleration.

5. A warp knitting machine according to claim 3 wherein the ground portion of said predetermined path time trajectory comprises segments of substantially constant acceleration.

6. A warp knitting machine according to claim 4, wherein said drive member means comprises:

a cam plate for driving said push rod means, said cam plate having a circumference shaped to produce said path time trajectory.

7. A warp knitting machine according to claims 6, wherein said push rod means comprises:

a contact roller for riding said circumference of said cam plate.

8. A warp knitting machine according to claims 1 wherein said drive member means comprises:

a motor connected to said push rod means for axially reciprocating said push rod means; and computer coupled to said motor for controlling said motor, said computer having data storage means for establishing a pattern for causing said motor to move said push rod means with said path time trajectory.

9. A warp knitting machine according to claim 8 wherein said computer storage means comprises:

a first data storage area for storing data signifying said ground portion; and a second storage area for storing data signifying said compensating portion, said computer having computing means for determining the path time trajectory by linearly combining data of said ground portion and said compensating portion.

10. A knitting machine according to claim 8 wherein said joint path with said predetermined path time trajectory has, as said guides pass through said needle spaces, a component of axial motion exceeding that of said ground portion.

11. A knitting machine according to claim 10 wherein said compensating portion is coextensive with said ground portion.

12. A warp knitting machine according to claim 8 wherein the ground portion of said predetermined path time trajectory comprises segments of substantially constant acceleration.

13. A warp knitting machine according to claim 11 wherein the ground portion of said predetermined path time trajectory comprises segments of substantially constant acceleration.

* * * * *